United States Patent [19]

Rockola et al.

[11] Patent Number: 4,923,090

[45] Date of Patent: May 8, 1990

[54] DELIVERY ASSEMBLY FOR COIN-OPERATED CAN VENDING MACHINES

[75] Inventors: Donald C. Rockola, Chicago; Shuja Haque, Northbrook, both of Ill.

[73] Assignee: Rock-Ola Manfacturing Corporation, Addison, Ill.

[21] Appl. No.: 245,734

[22] Filed: Oct. 17, 1988

[51] Int. Cl.[5] ..... G07F 11/00

[52] U.S. Cl. ..... 221/312 R; 194/350; D20/5

[58] Field of Search ..... 221/12, 67, 75, 194, 221/195, 196, 312 R; 194/350; 312/45, 36; 193/2 R, 2 A, 33; D20/4, 5

[56] References Cited

U.S. PATENT DOCUMENTS

| | | | |
|---|---|---|---|
| D. 294,718 | 3/1988 | Morgan | D20/5 |
| 863,743 | 8/1907 | McLouth | 221/195 |
| 3,158,247 | 11/1964 | Gale | 221/67 X |
| 3,344,953 | 10/1967 | Krakauer et al. | 221/194 X |
| 4,485,937 | 12/1984 | Adams | 221/150 R X |

*Primary Examiner*—F. J. Bartuska

*Attorney, Agent, or Firm*—McCaleb, Lucas & Brugman

[57] ABSTRACT

A delivery assembly for a coin-operated can vending machine constituting a simplified structural arrangement of parts productive of economies of manufacture and assembly comprising a delivery shroud assembly mounted opposite and behind a delivery opening in the front door of the machine cabinet and formed by two identical stamped metal parts which are operationally interchangeable, are fixedly interjoined to form a can delivery passageway and which are supported on frame members carried within the interior of the cabinet door. A deflector is mounted across the shroud assembly passageway to alter the path of can movement therethrough. The outer end of the shroud assembly abuts the inside face of the front door panel adjacent a delivery opening therein and is fastened to a frame member disposed over the exterior of the front door panel. The frame member conceals the edges of the delivery opening and provides a hand opening for customer retrieval of a can delivered to a delivery stage of the shroud assembly. The frame further acts as an anti-theft barrier in conjunction with the deflector to prevent easy access to the cabinet's interior via the delivery assembly.

8 Claims, 2 Drawing Sheets

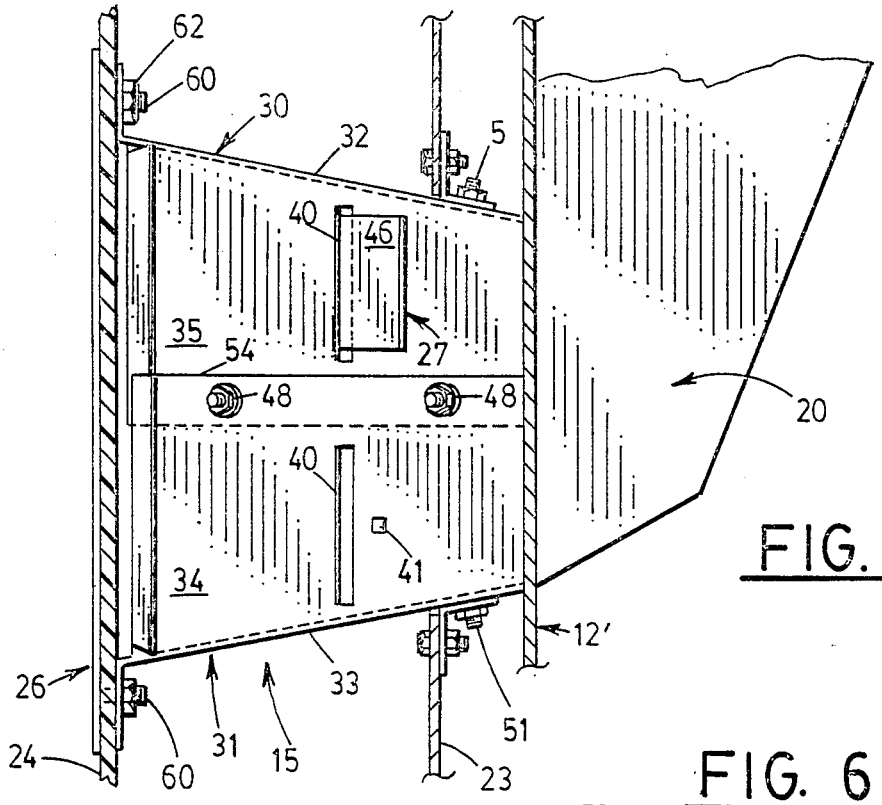
FIG. 3
FIG. 6
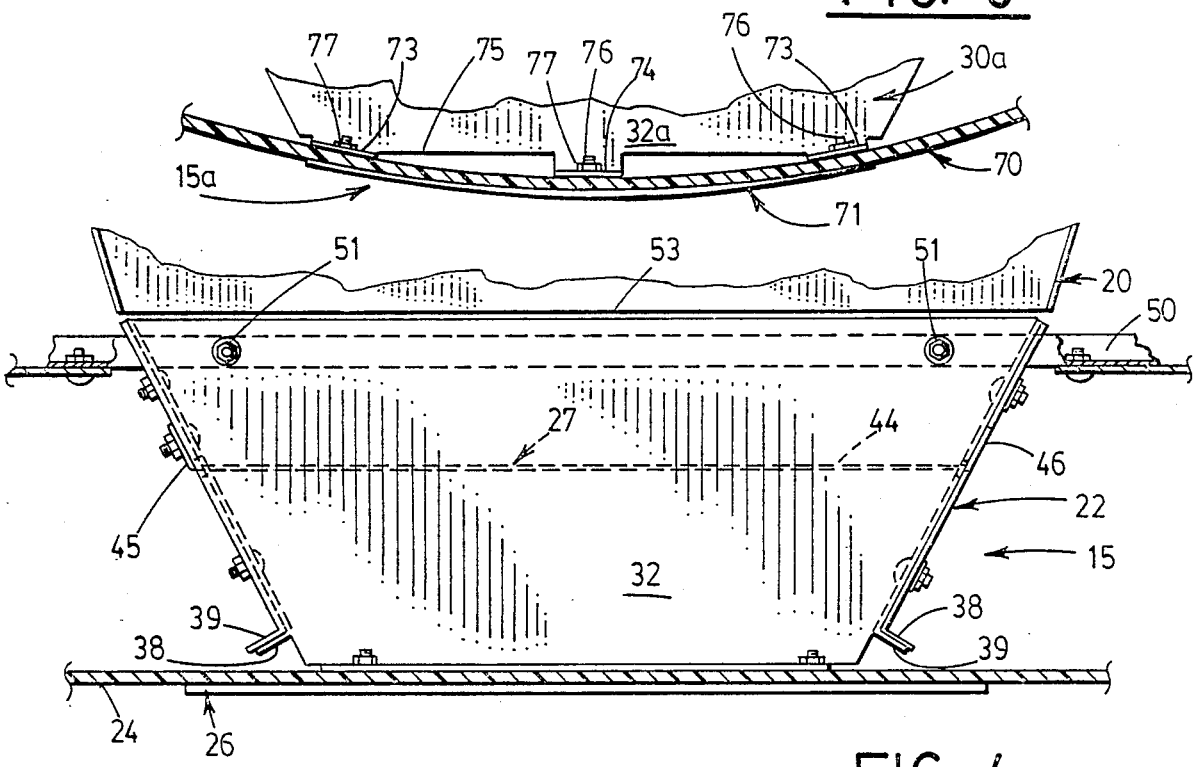
FIG. 4

DELIVERY ASSEMBLY FOR COIN-OPERATED CAN VENDING MACHINES

This invention relates generally to coin operated can vending machines and more particularly to improvements in assemblies for gravitationally delivering vend released cans or articles to a customer.

In a typical coin-operated vending machine for vending cylindrical articles, such as canned beverages, articles released by a vending mechanism within the machine's cabinet are deposited in a delivery chute which communicates directly with a delivery assembly accessible to the customer. In the usual case the cans are delivered to a passageway through the front door of the machine cabinet, coming to rest at a location which is openly accessible to the customer via a delivery opening in the outside panel of the front door.

In the past, such delivery assemblies have been excessively cumbersome, complex and expensive to manufacture and install. Aside from the delivery and deposit functions, such assemblies must provide security to prevent a customer from reaching through the door opening and delivery passageway to manually operate the vend mechanisms. Additionally the assembly should provide a suitable decorative or finished appearance about the delivery opening in the door face and must be capable of matching the contour of the door's front panel which in some instances is planar and in other instances is curvelinear or arcuate.

This invention is directed to an improved, novel, cost-effective and simplified assembly of parts which satisfies the above noted requirements and overcomes certain structural and security shortcomings of prior known assemblies for this purpose.

SUMMARY OF THE INVENTION

In brief, the improved delivery assembly of this invention comprises a simplified door-mounted shroud assembly which provides passageway for the gravitational movement of cans from the machine's interior to a customer accessible delivery stage via a delivery opening formed in the outside or front panel of the front door of the vending machine cabinet. Rigid deflector means are provided in the shroud passage way to assist in the deposit of cans at the delivery stage and decorative frame means are mounted exteriorly the door opening to conceal the edges thereof; such frame means having an opening accessible to the delivery stage and providing a barrier with the deflector means to prevent ready access to the can storage magazines and vend mechanisms within the cabinet.

An important object of this invention is to provide an improved and simplified assembly of parts for delivering articles to the customer of a coin-operated vending machine.

A further object of this invention is to provide an improved delivery assembly for use with coin-operated can vending machines which is characterized by its simplicity of manufacture, structure and operational function.

A still further object of this invention is to provide an improved assembly for delivering cans or the like through the door of a can vending machine cabinet and which includes simplified unitary means for finishing the edges of a delivery opening through the cabinet door.

Another important object of this invention is to provide a can delivery assembly for coin-operated vending machines which comprises a simple arrangement of parts capable of maintaining the interior of the machine cabinet secure from intrusion via the delivery system.

Having described this invention, the above and further objects, features and advantages thereof will be recognized by those skilled in the art from the following detailed description of preferred and modified embodiments thereof, illustrated in the accompanying drawings, and representative of the best mode presently contemplated for enabling those skilled in the art to make and practice this invention.

IN THE DRAWINGS

FIG. 3 is an enlarged side elevation of the assembly shown in FIG. 2, with parts thereof in section;

FIG. 4 is a top plan view of the assembly shown in FIG. 3;

FIG. 6 is an enlarged partial top plan view of the portion of the delivery assembly modified to accommodate the curvelinear faced front door of the FIG. 5 machine.

DESCRIPTION OF THE PREFERRED EMBODIMENT

Figure 1:
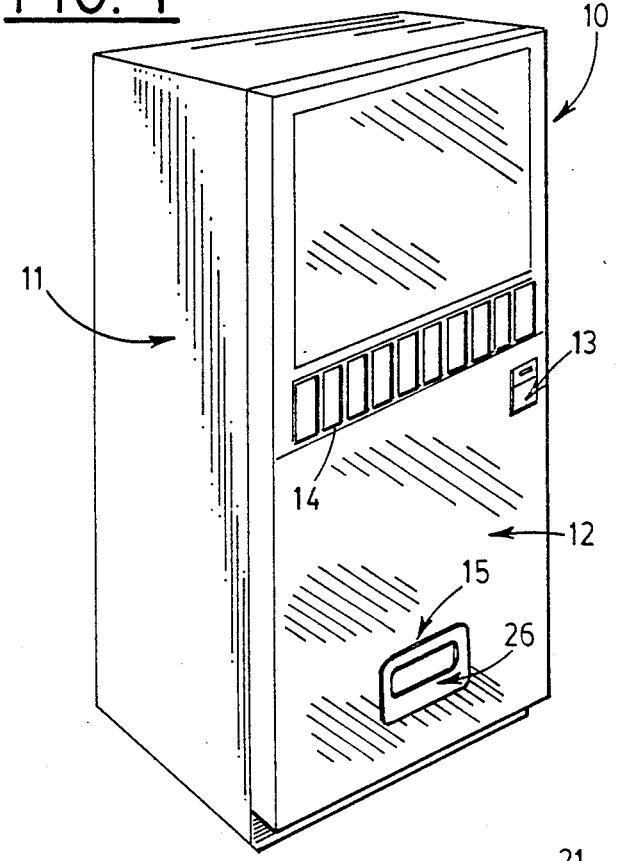
FIG. 1 is a perspective view of a typical coin-operated can vending machine having a planar front door and the delivery assembly of this invention.

With initial reference to FIG. 1 of the drawings it will be recognized that a coin-operated vending machine, indicated generally at 10 thereat comprises an upright rectangular shaped three dimensional cabinet 11 having a hingedly mounted front door 12 equipped with the usual coin receptor means 13, selection panel 14 and a delivery assembly 15 of this invention.

Figure 2:
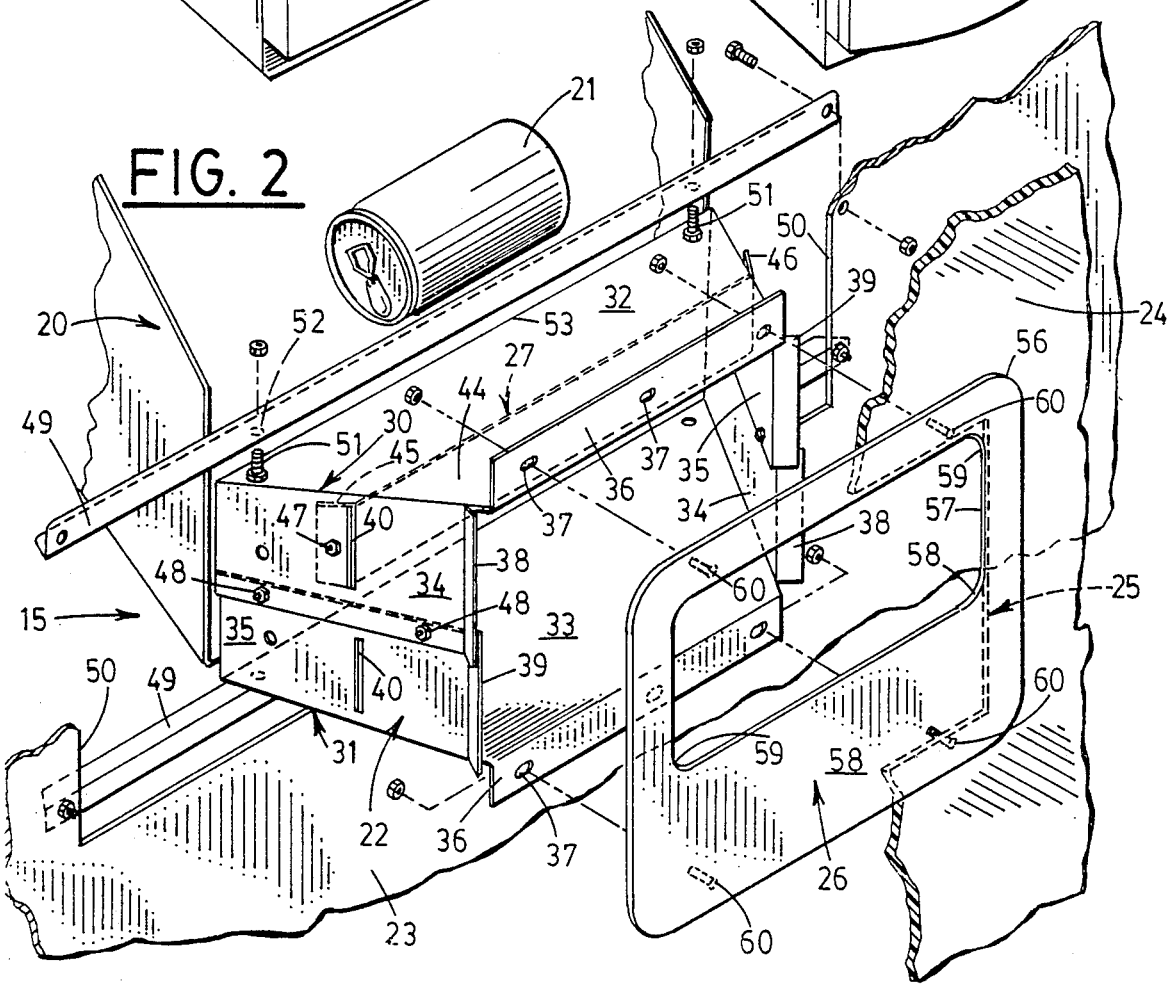
FIG. 2 is an exploded perspective view of the delivery system embodied in the machine illustrated in FIG. 1.

As will be better understood from FIG. 2 of the drawings, machine 10 includes an internal delivery housing or system indicated generally by 20 which is designed to receive articles, such as canned beverages 21 released from one or more storage magazines of the machine by operation of a suitable vend mechanism in response to customer selection and coin deposit in accordance with known and familiar practice. The delivery housing 20 leads to the inside wall of the front door 12 via an inner door 12' which encloses the refrigerated interior of the cabinet and is equipped with an appropriate trap door for the passage of the cans into the interior of a door mounted shroud assembly 22, according to this invention.

Shroud assembly 22, which will be described presently, extends between the inside panel 23, and an outside or front panel 24 of the cabinet door 12 to communicate with an enlarged delivery opening 25 formed in the door's outside panel; opening 25 being bounded by and partially covered by a frame member 26. In addition to the shroud assembly and the frame member 26, the delivery assembly 15 includes deflector means 27 which extends across the interior of the shroud assembly and serves to direct the path of movement of the cans 21 downwardly as they advances along the interior of the shroud assembly toward the frame member 26 for eventual delivery to the customer.

Turning now to the specifics of shroud assembly 22, references is made to FIGS. 2, 3 and 4 of the drawings from which it will be recognized that assembly 22 comprises a pair of identically formed, preferably stamped heavy metal parts or members 30 and 31 of general U-shaped cross section which are superposed in assembly with the lowermost part upside down from the uppermost. Parts 30, 31 comprises a large trapezoidal shaped planar wall 32 in the case of member 30, and a corresponding trapezoidal shaped wall 33 in the reversely positioned member 31 (see FIG. 3). Walls 32 and 33 are flanked by identically shaped smaller trapezium side walls 34 and 35 formed at right angles to the plane of, associated walls 32 and 33 in the particular illustrated case.

As best shown in FIG. 2 of the drawings the shroud members 30 and 31 are additionally formed with a large rectangular flange portion 36 along the smaller base edge of their respective trapezoidal walls 32 and 33; such flange portions are distinguished by plural spaced mounting openings 37 for attachment to the frame member 26, as will appear presently. In addition, the trapezium side walls 34 and 35 of the two members 30, 31, have the longer side leg thereof bent angularly outwardly to form lip portions 38 and 39 lying substantially at right angles to the planes of their respective side walls 34 and 35 (see FIG. 4). Such lip portions 38 and 39 serve to rigidify the structure and back up the door's front panel adjacent the delivery opening therein.

In addition to the lip portions 38 and 39, the trapezium side walls 34 and 35 of the two members 30, 31 are each distinguished by substantially centrally located elongated slotted opening 40, operationally oriented vertically and paralleling the lateral sides of the walls 34 and 35. Such slotted openings are registeringly aligned with one another. One such opening is adapted to receive one end of the deflector means 27 when the latter is mounted across the interior of the shroud assembly 22. It also will be noted that the trapezium walls 34, 34 of the two members 30 and 31, have a square opening or hole 41 pierced therethrough immediately adjacent the elongated slotted opening 40 therein (see FIG. 3).

Deflector means 27, as best shown in FIGS. 2, 3 and 4 of the drawings, constitutes an elongated rigid metal strap having a generally rectangular body portion 44 whose ends are bent outwardly at an angle to diverge from the plane of the body portion 44 and form a pair of divergent mounting ears 45 and 46 of like configuration. One mounting ear 45 is pierced with an opening receptive of a carriage bolt or like fastener 47 which locks into the square opening 41. Mounting ear 46 of the deflector 27 is first passed into the elongated slotted opening 40 in trapezium wall 35 of the uppermost shroud member 30, as shown best in FIGS. 2 and 4. Ear 45 is then disposed on the inside face of the trapezium wall 34 and affixed thereto by the bolt fastener 47 to lock the deflector in operating position.

With the deflector means 27 locked in position, as above noted, the two identical shroud members 30 and 31 may be assembled by overlapping the base margins of the side walls 34 and 35 thereof in the manner shown in FIG. 2. It will be noted that in the illustrated case, the side walls 34 overlap the side walls 35. Once the trapezium walls are positioned in the manner illustrated in FIG. 2, the same are secured together along their base margins by spaced connector bolts 48, 48.

The shroud assembly 22 is adapted to be supported between a pair of parallel spaced horizontally extending mounting bars or rails 49, 49 affixed to the door adjacent the upper and lower limits of opening 50 in the door's inside panel 23. Bolts 51 extend through suitable openings 52 in the mounting bars 40 and corresponding openings formed along the larger base margin 53 of the trapezoidal walls 32 and 33 for the two shroud members.

Due to the trapezium configuration, the side walls 34 and 35 of the shroud members 30, 31, have one longer side leg so that the base edges thereof which merge with the trapezoidal walls 32 and 33, respectively, are an angle to the opposite base edges 54 thereof. Consequently, the planes of the trapezoidal walls 30 and 33 in the relationship of parts illustrated in FIG. 2, for example, divergently slope from back-to-front of the shroud assembly and door. Thus the inlet throat of the shroud assembly which initially receives the cans 21 delivered thereto, is of smaller vertical dimension than the discharge throat thereof at the opposite or discharge end of the assembly 22, with walls 32 and 33 sloping upwardly and downwardly, respectively. The downwardly sloping attitude of the bottom most wall 33 of the shroud assembly materially assists in the gravitational flow of cans beyond and beneath deflector means 27 until they are arrested against the frame member 26.

With particular reference to FIGS. 1 and 2 of the drawings, it will be seen that the frame member 26, as therein illustrated, comprises a unitary planar rigid plate of generally rectangular formation having radiused or rounded corners 56 and provided with an enlarged generally rectangular opening 57 located in the upper half of the plate body 58. Opening 57 is of sufficient size to accommodate the entry of a customers' hand to retrieve a can 21 delivered against the frame member 26.

More specifically, the portion of the plate body of member 26 lying beneath the opening 57 and labeled 58 in FIG. 2, constitutes a delivery barrier against which, when the plate member is mounted over the front of the shroud assembly, constitutes means for arresting movement of the cans, thereby forming a customer accessible delivery stage with the bottom wall of the shroud assembly. Importantly, it is to be noted that due to the location and vertical extent of the barrier portion 58 and its positional relation to the deflector 27, a labyrinth passageway is formed through the shroud assembly which deters passage of a customer's hand and arm into the machine's interior. Thus, an effective anti-theft means to prevent access to and manual operation of the vend mechanism via the delivery shroud is provided.

The corners of the retrieval opening 57 are rounded also, as at 59 and the edges thereof are suitable coined or smoothed over to avoid sharp edges which might injure the customer.

In order to affix the frame member 26 to the shroud assembly, headless bolt members 60, 60 are welded to the inner face of frame member 26 to extend rearwardly adjacent the upper and lower margins thereof. There are four such bolts 60 in the illustrated embodiment, suitably spaced for acceptance in the openings 37 formed in the mounting flange portions 36 of the shroud assembly.

As best shown in FIG. 3 of the drawings, the frame member 26 is positioned over the exterior of the door's front panel 24 so as to extend over the borders and conceal the edges of discharge opening 25 therein (see FIG. 2). Frame member 26 is disposed so that the enlarged opening 57 thereof is located near the upper end thereof and with the fastener bolts 60, 60 extending through appropriate openings formed in the door's front panel 24 to pass through the bolt openings 37 of the shroud assembly whereat nut members 62 are threaded over the bolts 60 to secure the frame member 36 tightly in position and closely hold door panel between flange 36 and frame 26, as illustrated in FIGS. 3 and 4. It will be appreciated that frame member 26 reinforces and guards the borders of opening 61 through the front door panel and finishes the exterior appearance of the delivery assembly 15.

Figure 5:
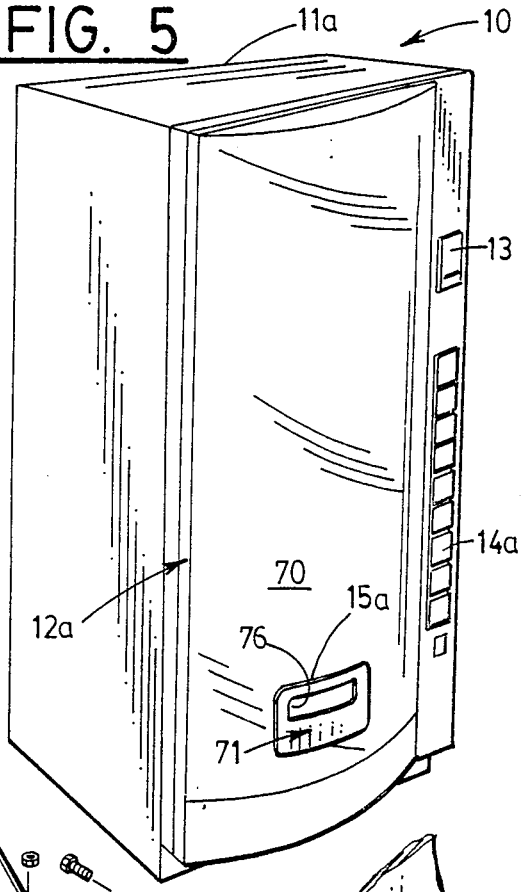
FIG. 5 is a perspective view of a can vending machine having a modified curvelinear faced front door, equipped with a modified delivery assembly of this invention.

Although the above described embodiment of the delivery assembly of this invention is related to a vending machine cabinet having a planar front door panel, as noted, modification thereof is to accommodate a transversely curved front door panel is fully contemplated. To that end reference is made to FIGS. 5 and 6 of the drawings illustrative of a modified curvelinear door structure. As shown in FIG. 5, a vending machine 10*a* has an upright cabinet 11*a* with a modified front door 12*a* equipped with money receiver 13 and selector panel 14*a*. The door is particularly distinguished by a transversely curvelinear or semi-cylindrical front panel 70 bearing a modified delivery assembly 15*a* according to this invention.

As shown in FIG. 6 of the drawings it will be understood that a transversely curved frame member 71, otherwise identical to frame member 26, is adapted to conform to the curve of the front door panel 70 which has an appropriate delivery opening therethrough as in the first described embodiment of FIGS. 1–4 of the drawings. The basic modification of assembly 15*a* over that of the first described assembly 15 constitutes a modified structure of the shroud members 30, 31 along with the curvelinear formation of the frame member 71. Specifically the shroud member 30*a* therein illustrated (the second shroud member being of like formation) has been modified to eliminate the single planar mounting flange 36 of the first described embodiment by replacing the same with laterally spaced upwardly turned mounting ears 73, 73 of like formation and a centrally disposed mounting ear 74. Such ears are located along the leading edge 75 of the trapezoidal wall portion 32*a* of the modified shroud member shown. The ears 73, 73 are adjacent the lateral limits of the smaller base margin of the trapezoidal wall 32*a* and disposed at a angle to its leading edge 75 for reception of connector bolts 76 extending from the inside face of the curved frame member 71. Disposed substantially centrally between the angularly disposed mounting ears 73, 73 is a central mounting ear 74 which extends upwardly from the plane of wall 32*a* and likewise receives a fastening bolt 76. The bolts 76 cooperate with fastener nuts 77 to lock the frame to the shroud assembly and front door panel 70 as in the FIG. 1–5 embodiment.

With the angular disposition of the mounting ears 73, 73 and the centrally disposed mounting ear 74 which parallels the leading edge of trapezoidal wall 32*a*, the curvelinear formation of the front panel 70 of the modified door assembly 12*a* is readily accommodated to rigidly support the door panel about the delivery opening therethrough. Frame 71 has an enlarged opening 76 for retrieval of cans delivered by the shroud assembly, all as first described herein.

Having described this invention, it is believed that those familiar with the art will readily recognize and appreciate the novel advancement thereof over the prior art and will understand that while the same has been herein described in association with preferred and modified embodiments the same is susceptible to variation, modification and substitution of equivalents without departing from the spirit and scope of the invention which is intended to be unlimited by the foregoing except as may appear in the following appended claims.

The embodiments of the invention in which an exclusive property or privilege is claimed are defined as follows:

1. In a coin-operated can vending machine having an upright cabinet equipped with a front door including a front panel having a delivery opening therethrough, a door mounted gravitational delivery assembly receptive of cans from the machine's internal storage and delivery system, comprising:

a shroud assembly adapted to be mounted within the interior of the door opposite the delivery opening in the front panel thereof, comprising, a pair of identical shroud members of substantially U-shaped cross section, means for assembling said members in superposed relation with the side walls thereof interconnected in overlapping relationship and the lowermost member upside down with respect to the uppermost member; each of said members having a planar upper wall laterally flanked by divergently related planar side walls; means for supporting the assembled said members within the door so that said side walls thereof converge and the upper walls thereof diverge from back to front of said door and abut the inside of the door's front panel; a rigid frame member formed as a unitary plate of uniform thickness having an enlarged opening therethrough adapted to be mounted over the exterior of the door's front panel to border and partially obstruct the lower regions of said delivery opening therein, means for interconnecting said shroud and frame members so that said front panel is embraced closely therebetween, and deflector means extending between and connected to the side walls of the uppermost of said shroud members to partially block the interior thereof and cooperate with said opening in said frame member to substantially prevent manual entry to the machine's interior via said assembly.

2. The delivery assembly of claim 1, wherein said frame member is formed to conform with the exterior contour of said front panel.

3. The assembly of claim 2, wherein said frame member and door panel are planar.

4. The assembly of claim 2, wherein said frame member and door panel have a transverse curvature of formation.

5. The assembly of claim 1, characterized by said shroud and frame members being formed as unitary metal stampings.

6. The delivery assembly of claim 1, wherein the enlarged opening in said frame member is operationally disposed opposite said deflector means whereby to provide an anti-theft barrier therewith.

7. The assembly of claim 1, wherein the front panel of the cabinet door is transverse curvelinear, said frame member is formed with matching curvature, and said shroud members are constructed with portions adapted to abuttingly engage the inside of said front panel at laterally spaced locations to support said panel and provide means receptive of connective fasteners extending from said frame member.

8. The assembly of claim 1, wherein said upper wall of each said member is trapezoidal and said side walls thereof are trapeziums whereby in the superposed assembly of said members opposing said upper and side walls thereof lie in divergent relationship.

* * * * *